US005353619A

United States Patent [19]

Chu et al.

[11] Patent Number: 5,353,619

[45] Date of Patent: Oct. 11, 1994

[54] APPARATUS AND METHOD FOR NECKING TUBULAR MEMBERS SUCH AS CONTAINERS

[76] Inventors: Richard Chu, 10641 Dale Ct., Westminster, Colo. 80234; Roger A. Hahn, 6469 Iris St., Arvada, Colo. 80004

[21] Appl. No.: 983,825

[22] Filed: Dec. 1, 1992

[51] Int. Cl.[5] ..... B21D 19/04

[52] U.S. Cl. ..... 72/121; 72/126

[58] Field of Search ..... 72/120, 121, 115, 124, 72/126, 353.4, 379.4, 370

[56] References Cited

U.S. PATENT DOCUMENTS

| | | | |
|---|---|---|---|
| 3,260,089 | 7/1966 | Hazelton et al. | 72/126 |
| 3,687,098 | 8/1972 | Maytag . | |
| 3,811,306 | 5/1974 | Yoshimura | 72/126 |
| 3,831,416 | 8/1974 | Wolfe | 72/126 |
| 3,913,366 | 10/1975 | Nelsen et al. | 72/124 |
| 4,091,648 | 5/1978 | McCaslin | 72/124 |
| 4,173,883 | 11/1979 | Bolk . | |
| 4,403,493 | 9/1983 | Atkinson . | |
| 4,450,700 | 5/1984 | Robertson et al. | 72/115 |
| 4,519,232 | 5/1985 | Traczyk . | |
| 4,774,839 | 10/1988 | Caleffi et al . | |
| 5,150,595 | 9/1992 | Ihly | 72/126 |

*Primary Examiner*—Daniel C. Crane

*Attorney, Agent, or Firm*—Timothy J. Martin; Carl Schaukowitch

[57] ABSTRACT

An apparatus and method for necking tubular members such as cans utilizes an inner die that expands to support a neck portion to be formed by an outer die that travels around the neck. The inner die has a plurality of first die elements which may be retracted after the neck is formed so that the inner die may be removed. Selected ones of these first die elements nest with the others in the retracted state. Drive assemblies operate each of the inner and outer dies, and the drive assembly for the inner die operates to differentially drive the first die elements to allow nesting to occur. Preferably, the inner drive assembly employs a reciprocally retracting cam, and the first die elements have cam followers to allow reciprocation. A wedge cam can be used to support the first die element sin the expanded configuration, and a wedge drive moves the wedge cam into and out of position. Mechanical timing is provided, and a plurality of necking apparatus may be mounted in a turret-type machine that includes mechanisms to advance the tubular members to be formed.

26 Claims, 8 Drawing Sheets

APPARATUS AND METHOD FOR NECKING TUBULAR MEMBERS SUCH AS CONTAINERS

FIELD OF THE INVENTION

The present invention generally relates to metal fabrication, and, more particularly, to intermediate fabrication of tubular members. The present invention specifically concerns apparatus and methods for necking tubular members of a selected diameter in order to form a neck having a reduced diameter. The present invention is especially directed to an apparatus and method for necking the open end of a container, such as a metal beverage can, in order to reduce the opening size prior to receipt of a lid.

BACKGROUND OF THE INVENTION

The desirability of fabricating metal into useful implements and objects have long been known and available fabrication techniques are varied. In the particular area of fabricated tubular members, it is often useful to further fabricate an end portion thereof to form a neck so the tube opening has a diameter that is smaller in size than the diameter of the original tube and, therefore, of the remaining tube body. A particular industry which widely employs a necking procedure and the industry to which the present invention is specifically directed is the container industry wherein tubular members are fabricated into containers adapted to receive goods for packaging. Such containers may be beverage containers, spray cans, food packaging containers, and the like.

In some instances, containers as described above are made from a metal tubular body which is enclosed at opposite ends by a bottom end structure and a lid structure. This type of three-piece construction is commonly employed, for example, in many types of aerosol containers. In such constructions it is relatively easy to provide forming dies or punches which can conveniently neck one end of the tubular body since the interior die or punch can easily be removed from the open end remaining after the opposite end has been reduced in size to form the neck. One such example is shown in U.S. Pat. No. 4,173,883 issued Nov. 13, 1979 to Boik. In this patent, it is taught how a cylindrical body blank may have one end portion progressively reduced in diameter to form a neck in the shape of a frustoconical dome by means of a plurality of inside tools in the form of punches and a plurality of outside tools in the form of dies which configure the end portion of the neck in a stepwise manner.

A different problem, however, occurs when it is desired to neck the open end of a two-piece can of the common type of metal containers used in the beer and beverage industry. These cans, whether made of aluminum or tin plated steel, have a cylindrical body formed with an integral bottom end wall. A separately formed top end or lid portion is double seamed onto the open end of the can body after the can has been filled with product. The desirability for necking the open end of the cylindrical can body prior to filling the can with product and seaming on the lid is well known. On one hand, the reduction in diameter adjacent its top is sufficient to provide space within the geometric projection of the outer diameter of the can body for the rim or chime formed on the outer side of the top edge of the lid when the lid is applied to the can body. When necking is omitted, the chime protrudes radially outwardly beyond the geometric projection of the container body and interferes with the efficient packing of the containers where a manufacturer desires to have the container bodies in close contact with one another without the spacing caused by the protruding rims. Furthermore, it is desirable to recess the rims within the cylindrical projection of the can body in order to be compatible with certain dispensing equipment.

On the other hand, and perhaps of greater importance, it is desirable to reduce the opening size of the container in order to reduce the diameter of the lid which is to be seamed thereon. Where such containers are aluminum cans, as is now the standard practice used in the soft drink or beer industry, the lid panel must be made of a metal thickness gauge that is on the order of at least twice the thickness of the can sidewall. By minimizing the opening size, the amount of total metal used in construction is reduced without sacrificing the structural integrity of the container sidewall. This can result in substantial cost savings for the can manufacturer and user as well as being more efficient from the standpoints of energy and materials usage.

Can manufacturers and fillers have heretofore been known to utilize two types of necking systems to reduce the diameter of the open end of a tubular can. One such technique is known as "spin-necking" and the other is known as "die-necking." Where progressive die sets are used in die-necking, the open end is sequentially formed by a plurality of die sets to produce an inwardly tapering neck portion. However, die-necking often produces noticeable circumferential steps or rib lines along the neck which correspond to each of the die sets used in the progressive fabrication. It is known to sometimes reform the neck end portion with an external forming roller to eliminate at least some of the steps or ribs to produce a frustoconical portion having a substantially more uniformed inwardly curving neck wall. In the spin-necking procedure, a plurality of die necking operations reduce the diameter of the container neck. Forming rollers rotate about the circumference of the necked container as it is withdrawn from the forming station in order to smooth out circumferential ridges formed when the neck was initially formed. Despite the use of those forming rollers, undesirable circumferential rib lines often remain on the neck surface. Furthermore, it has been found that spin-necking stretches and thins the neck metal which thereby weakens the neck and, it is even possible that the necked end portion of the can will have a distortion in symmetry which can create problems in seaming a lid thereon.

Accordingly, while there have been substantial developments in metal fabrication techniques for necking the open end of a tubular member and specifically the open end of a tubular can having a closed end formed integrally with the cylindrical sidewall thereof, there remains a need for improved structures which can form necked portions for such tubular members and cans so that the necks have a smooth pleasing appearance, uniformity, structural integrity, etc. There is further a need for apparatus and methods for necking tubular members and cans which can operate at high speeds with reduced risk of breakdown due to simplified construction. There is a further need for improved manufacturing equipment and methods employed thereby which equipment is relatively durable and which requires low maintenance.

SUMMARY OF THE INVENTION

It is an object of the present invention to provide a new and useful apparatus and method for necking tubular members such as containers whereby an end portion of the tubular member or container is reduced in diameter.

A further object of the present invention is to provide an apparatus and method for necking an end portion of a tubular member in a manner that creates a uniform necked portion without substantially affecting the structural integrity of the tubular sidewall at the transition region between the tubular body an the necked portion.

Another object of the present invention is to provide a necking apparatus and method employing an internal die formed or a plurality of sections which may be moved between an expanded state and a retracted state so that, when expanded, the internal die provides a continuous working surface against which an end portion may be pressed to form said neck but which can be collapsed to allow removal from the open end once it has a reduced opening size.

It is a still further object of the present invention to provide an apparatus and method for necking cans which provides a plurality of forming stations operative to receive can blanks from a single feed location and to discharge neck can blanks at a single discharge location in a high speed manner.

A further object of the present invention is to provide a simplified and durable apparatus, and a method employed by such apparatus, to neck cans in a manner controlled by mechanical timing.

In order to accomplish these objects, the present invention is directed to an apparatus and method for necking an inner portion of the tubular member, such as a cylindrical can blank, wherein the tubular member has an interior of a selected diameter. In its broad form, the present invention includes an inner die which is relatively insertable into the interior of the tubular member at the end portion to be necked. The inner die includes a plurality of cooperative first die elements which are movable between an expanded state and a retracted state. When in the expanded state, the first die elements together form a first working surface configured in a shape corresponding to the neck to be formed and which, in the retracted state, can be removed from the interior of the tubular member from the neck opening after the neck is formed. An inner die drive assembly is provided that is operative to reciprocately drive the first die elements between the expanded state and the retracted state. An outer die is provided with the outer die having a second working surface configured in a shape complementary to the first working surface. The outer die is positioned in close proximity to the first working surface of the first die elements when they are in the expanded state in order to provide a necking channel between the first working surface and the second working surface of the outer die. This necking channel is operative to receive the end portion of the tubular member to be necked. An outer die drive assembly operates to advance the outer die around the inner die when the first die elements are in the expanded state and when the end portion of the tubular member is in the necking channel thereby to conform the end portion into the neck.

Preferably, each of the first die elements is constructed as an L-shaped piece having a forming finger and an actuator arm, and two types of complementary first die elements are described. The first die elements are arranged so that the forming fingers are oriented in a cylindrical configuration surrounding an open region with the actuator arms extending radially outwardly. Thus, the forming fingers are parallel to one another and are oriented circumferentially around the open region in a cylindrical configuration when the first die elements are in the expanded state. A die cam is operative to reciprocally drive the actuator arms in the radial direction to move the forming fingers radially apart from one another when in the expanded state and radially toward one another when in the retracted state. To this end, the die cam may provide a cam surface with a plurality of slots adapted to receive follower posts with there being an actuator post on each of the actuator arms. Thus, as the die cam is reciprocally rotated the actuator arms and thus the forming fingers of the first die elements are radially reciprocated. The inner die may also include a second die element in the form of a circular wedge adapted to be moved into and out of the region surrounded by the forming fingers so that, when interposed between the forming fingers when the first die elements are in the expanded state, the circular wedge positively supports the forming fingers against radially inward movement in order to prevent the first die elements from moving into the retracted state and thus positively support the forming fingers as the outer traveling die conforms the open end portion of the tubular member against the forming fingers. A wedge cam drive assembly reciprocally drives the second die element between the first an second positions, and a mechanical timing system is provided to coordinate the movement of the first and second die elements.

The outer die includes at least one but preferably a plurality of roller dies each having a circumferential surface which defines the second working surface that compliments the first working surface defined by the forming fingers. Each of the roller dies are rotatably journaled for rotation on a roller axis and, where a plurality of roller dies are provided, they are equiangularly spaced around the inner die. The outer die drive assembly may then include a rotatable collar surrounding the inner die with each of the roller dies being mounted for rotation on the rotatable collar. Thus, as the rotatable collar rotates around the inner die, the roller dies move in a circular manner while simultaneously rolling around the open end of the tubular member positioned within the necking channels. The collar may be constructed as a planetary gear mounted against an outer ring gear so that, as the ring gear and collar is relatively moved, the ring gear rotates the collar. To this end, a plurality of collars and associated inner and outer dies may be provided to create a plurality of forming stations, with the plurality of collars being equiangularly disposed around the inner circumference of the ring gear.

Preferably, the cam necking apparatus of the present invention includes a plurality of forming or necking stations which are mounted to a drive wheel connected to a driven shaft. The shaft is rotatably journaled with respect to a turret and ring gear assembly so that each necking station is structured as a planetary gear that travels around the ring gear in the turret. Each necking station includes a collar rotatable on a collar axis with the collar having gear teeth that engage the ring gear. Each collar rotatably journals a plurality of equiangularly spaced roller dies comprise the second die assembly for the necking station. The first die assembly for each necking station includes an intermediate collar and a die cam which relatively reciprocate with respect to one another to retract and expand the die elements which co-act with the roller dies in necking the can. A star wheel receives cans at an entry station, and the star wheel rotates in common with the drive wheel so that the cans are always maintained in alignment axially with the collar axis. A push rod guide plate rotate in common with the star wheel and drive wheel and receives a plurality of push rods connected to push pads that are aligned with each bay in the star wheel that receives a can to be formed. Each push rod includes a follower roller that travels along a circular ramp which varies in height so that the push rods and pads are actuated to move cans into and out of engagement with each respective necking station.

As noted, the present invention provides a method for necking the end portion of a tubular member such as a can or other container in order to form a reduced diameter opening. The broad method includes the steps of providing an inner die that is relatively insertable in the interior of the tubular member and which is constructed of a plurality of cooperative die sections movable between an expanded state to form a first working surface configured in the shape corresponding to the neck to be formed and a retracted state wherein the die sections can be removed from the interior of the tubular member after the neck is formed. Next, the method includes the step of providing an outer die having a second working surface configured in a shape complimentary to the first working surface and positioned in closely spaced relation to the first working surface and the die sections are in the expanded stated thereby to provide a necking channel. The method then includes the step of reciprocally driving the die sections between the expanded and the retracted state and placing the end portion of the tubular member into the necking channel when the die sections are in the expanded state. While in the necking channel, the broad method includes the step of advancing the outer die around the inner die to conform the end portion of the tubular member into the neck. Finally, the broad method includes the step of separating the tubular member and the inner die after the neck is formed and while the die sections are in the retracted state.

These and other objects of the present invention will become more readily appreciated and understood from a consideration of the following detailed description of the preferred embodiment when taken together with the accompanying drawings.

DETAILED DESCRIPTION OF THE EXEMPLARY EMBODIMENT

The present invention concerns neck forming apparatus and method adapted to reduce the diameter of an end portion of a tubular member and is particularly useful in the container industry. Thus, for example, the apparatus and method has particular usefulness in the beverage can industry wherein a can having a tubular container body and integral bottom has an open end portion that is necked to a reduced diameter in order to reduce the overall weight of the can by reducing the amount of material used for a lid structure that is rimmed onto the open end after necking and after the can is filled with product to be packaged. Accordingly, then, the exemplary embodiment of the present invention is described with respect to can necking apparatus, but it should be appreciated and understood that the concepts taught by the present apparatus and method may be implemented to form a neck on other types of tubular members, containers, and the like, without being restricted only to beverage cans.

Figure 1:
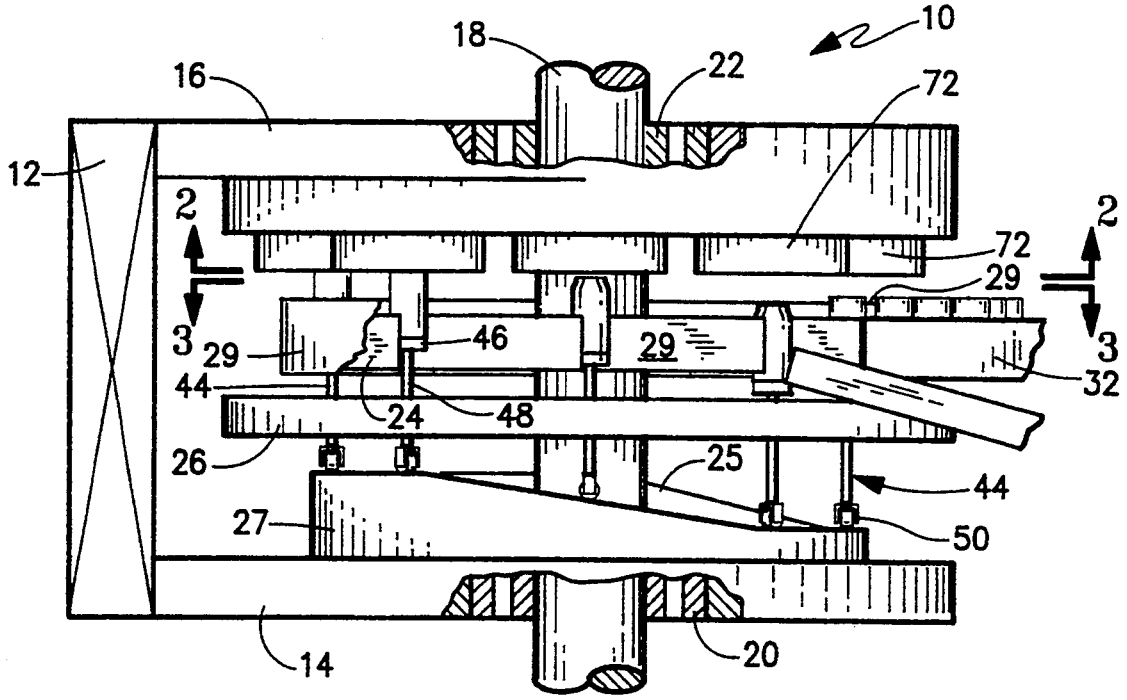
FIG. 1 is a side view in elevation showing an exemplary embodiment of the necking apparatus for tubular members according to the present invention operative to implement the method of the present invention when used to neck beverage cans.
Figure 2:
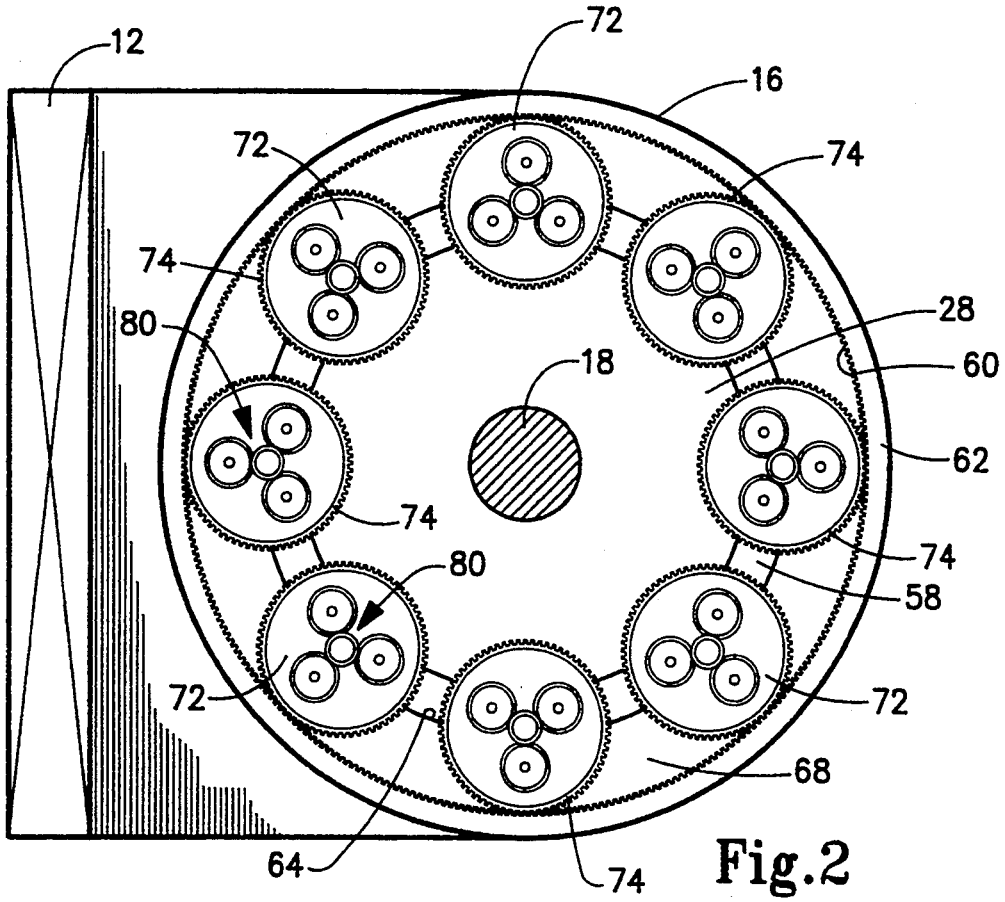
FIG. 2 is a cross sectional view taken about lines 2—2 of FIG. 1.
Figure 3:
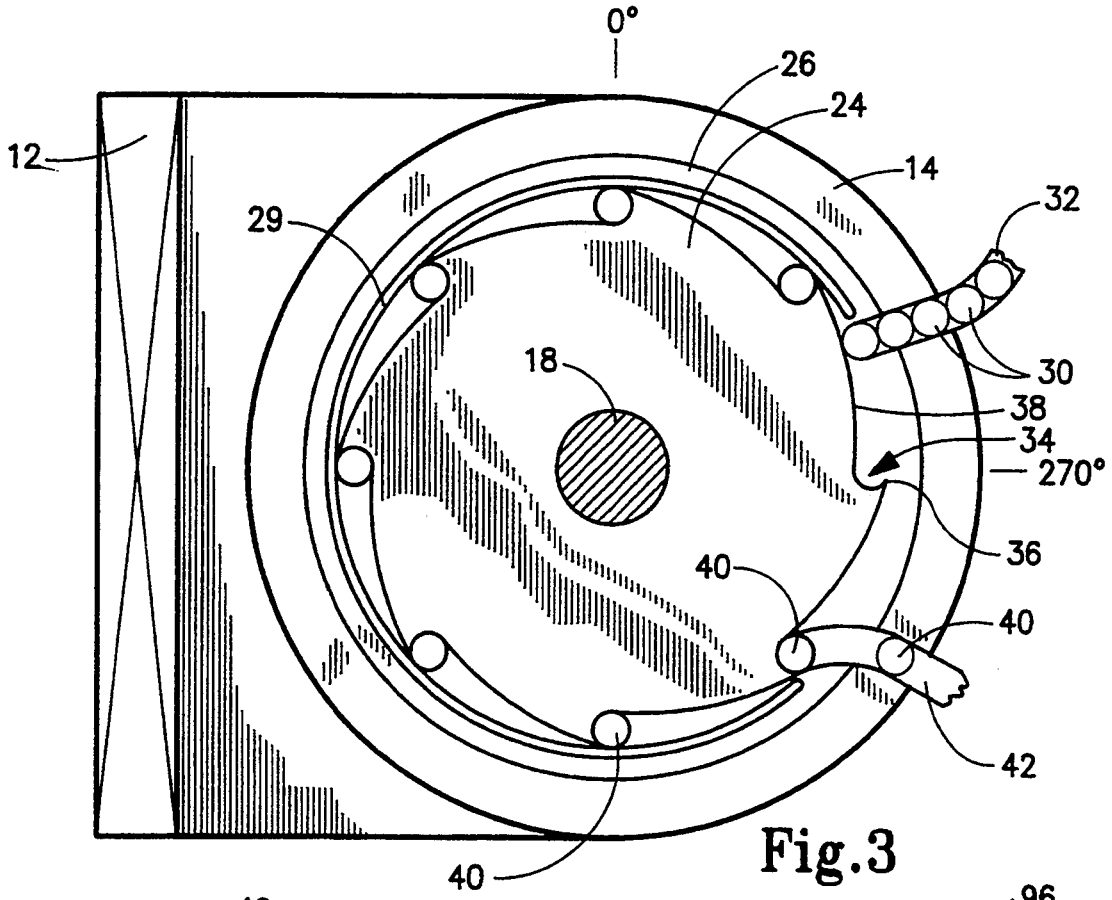
FIG. 3 is a cross sectional view taken about lines 3—3 of FIG. 1.

With reference then to FIGS. 1–3, it may be seen that forming apparatus 10 is mounted to a rigid support 12 and includes a platen 14 and a turret 16 rigidly secured to support 12. Platen 14 and turret 16 are in spaced apart parallel relation to one another and rotatably receive a shaft 18 that is supported in bearings 20 and 22 in platen 14 an turret 16, respectively. Shaft 18 is shown to be oriented vertically with platen 14 and turret 16 oriented horizontally; however, it should be understood that it is equally possible to orient shaft 18 horizontally with platen 14 and turret 165 in a vertical position. In either case, a star wheel 24 is rigidly mounted to shaft 18 and is located centrally between platen 14 and turret 16. A push rod guide plate 26 is then rigidly mounted to shaft 18 between star wheel 24 and platen 14. Finally, a circular drive plate 28 is rigidly mounted to shaft 18 and is located between star wheel 24 and turret 16 but is in closely spaced relation to that surface 58 of turret 16.

Star wheel 24, as best shown in FIGS. 1 and 3, is operative to consecutively receive can blanks 30 from a feed chute 32, and revolve can blanks 30 around shaft 18 to be necked, and then discharge the necked can blanks 40 at a discharge chute 42. To this end, star wheel 24 has a plurality of equiangularly spaced can receiving bays 34 each provided with a lip 36 operative to catch a can blank 30 from feed chute 32 and retain can blank 30 and the resulting necked can blank 40 in a respective bay 34 as it is revolved to discharge chute 42. Star wheel 24 thus has arcuate peripheral surfaces 38 extending between each adjacent bay 34, as best shown in FIG. 3. To help retain the can blanks 30, 40, a shield 29 extends around star wheel 24.

Figure 4:
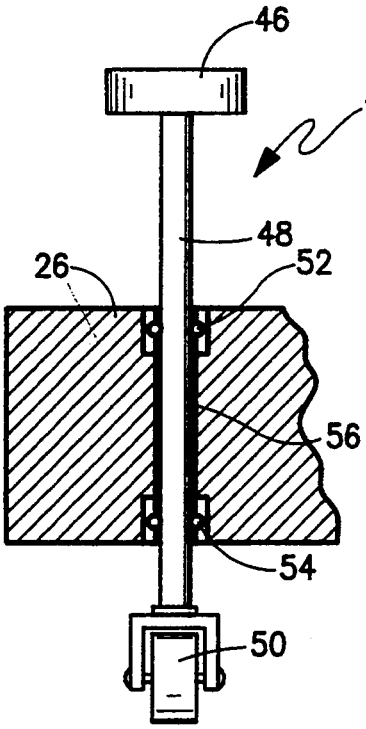
FIG. 4 is a side view in partial cross-section showing a can push plate assembly.

As best shown in FIGS. 1 and 4, guide plate 26 is adapted to receive a plurality of push plate assemblies 44 which are equiangularly spaced around the perimeter of guide plate 26 and which are each aligned with a respective bay 34 in one-to-one correspondence therewith. With reference to FIG. 4, it may be seen that each push plate assembly 44 includes a disc-shaped push plate 46 rigidly attached at a first end of a push rod 48. A follower roller 50 is rotatably journaled at an end of push rod 48 opposite push plate 46, and push rod 48 is mounted between a pair of bearings 52 and 54 so that push rod 48 extends through a bore 56 and be supported by bearings 52 and 54 for longitudinal sliding movement with respect to guide plate 26.

Figure 5:
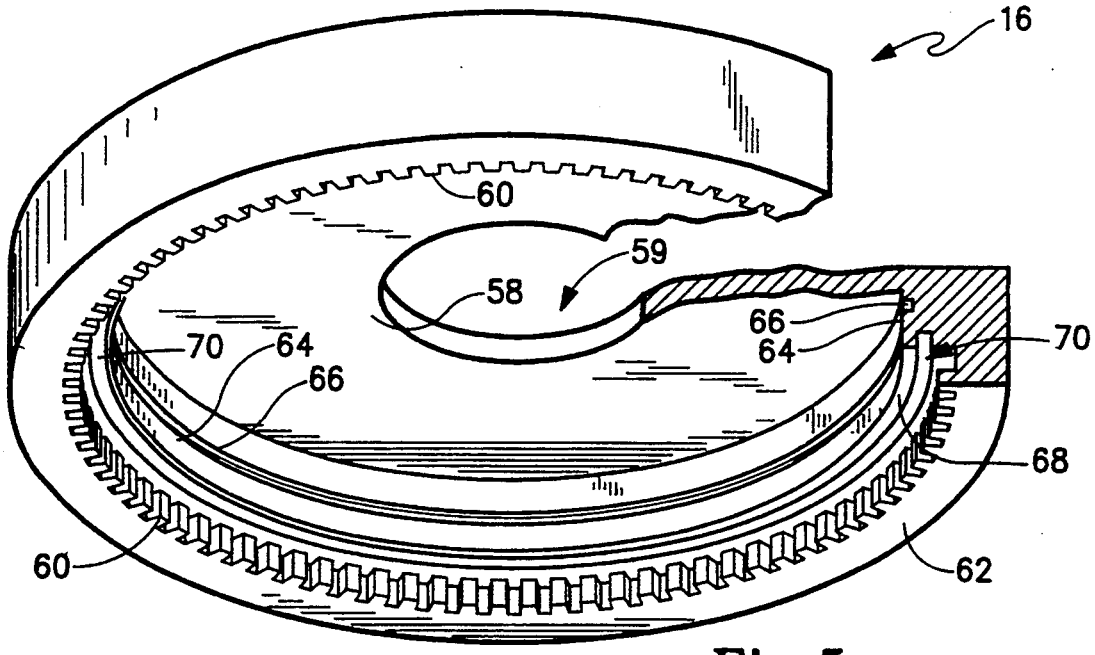
FIG. 5 is a bottom view in perspective and partially broken away showing the turret operative to receive the work stations of FIGS. 1, 2, 6 and 7 and showing the ring gear and cam channel structures therein.

Turret 16 is best shown in FIG. 5 and has a central opening 59 through which shaft 18 passes. Extending around the inner portion of peripheral rim 62 of turret 16 is a ring gear 60 which may be fit into and attached to turret 60 or which may be formed integrally therewith. Turret 16 also provides camming channels operative to mechanically time several steps in the necking process. For example, a cam channel 66 is formed in an inner surrounding face 62 of turret 16 and is operative to reciprocally drive a wedge die element 84; similarly, a cam channel 70 is formed in an intermediate cam surface 68 of turret 16 and is operative to reciprocally drive intermediate collars 102, their respective die cams 96 and thus die elements 82. The reciprocal operation of these die elements is described more thoroughly below.

Drive plate 28 carries a plurality of necking assemblies 72 which each engage ring gear 62 of turret 16. In FIG. 2, eight such necking assemblies 72 are shown and are equiangularly spaced around drive plate 28 and thus turret 16. Each necking assembly 72 includes an outer collar 74 formed as a planetary gear having gear teeth 75 sized to engage teeth 61 of ring gear 60. Accordingly, as drive wheel 28 rotates with shaft 18, each necking assembly 72 travels around the peripheral circumference of turret 18; collars 74 each rotate on a central axis due to the planetary gearing. Die assemblies 80 are located on the central axis of each necking assembly 72 with the structure of these die assemblies 80 being described more thoroughly below.

Figure 6:
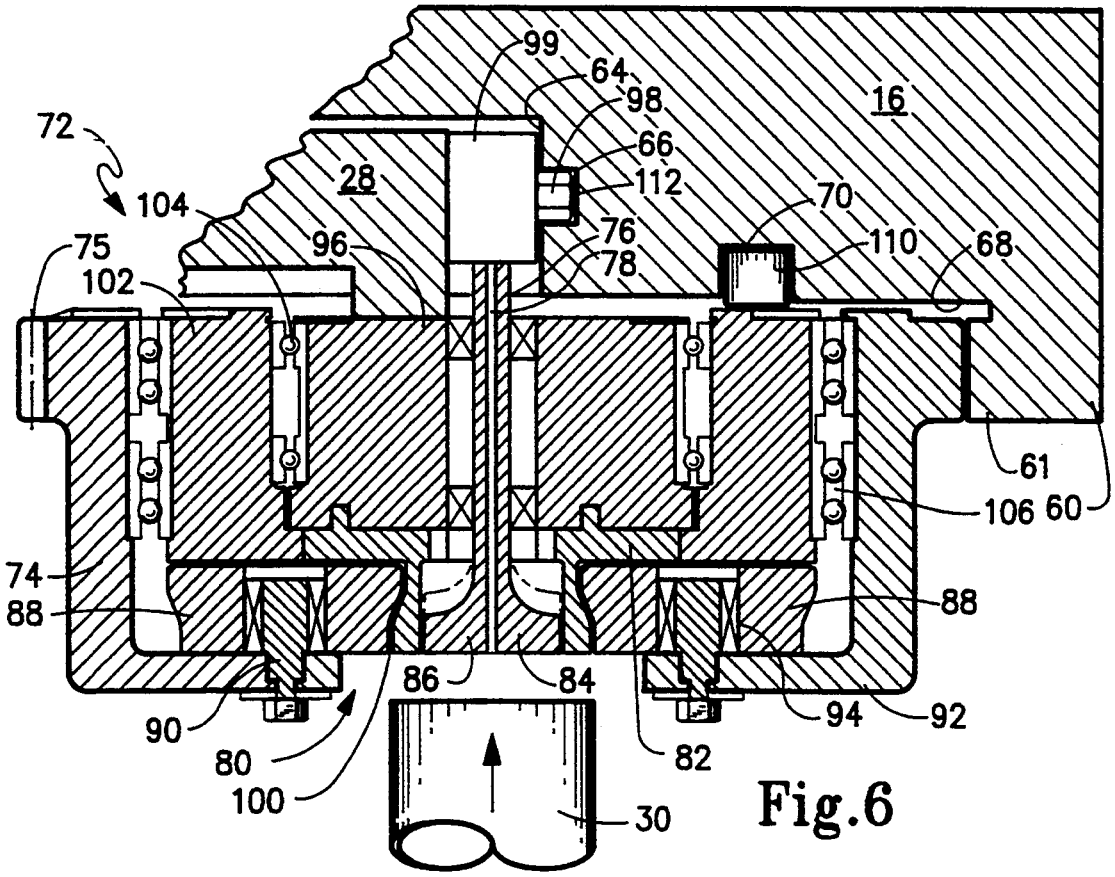
FIG. 6 is a cross sectional view of a representative necking assembly work station used in the exemplary embodiment of the present apparatus shown in FIG. 1 and showing the inner die in an expanded state ready to receive a can blank.
Figure 7:
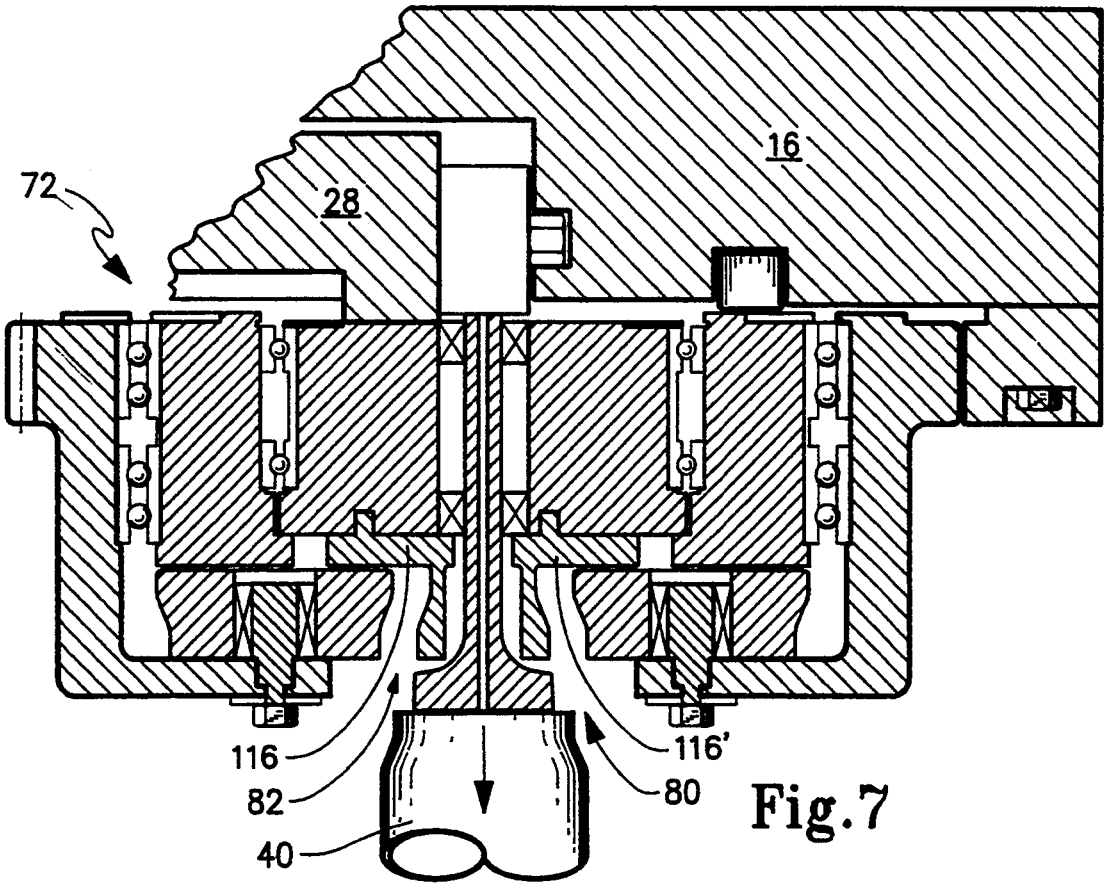
FIG. 7 is a cross sectional view similar to FIG. 6 showing the inner die in a collapsed state discharging a neck can blank.
Figure 8A:
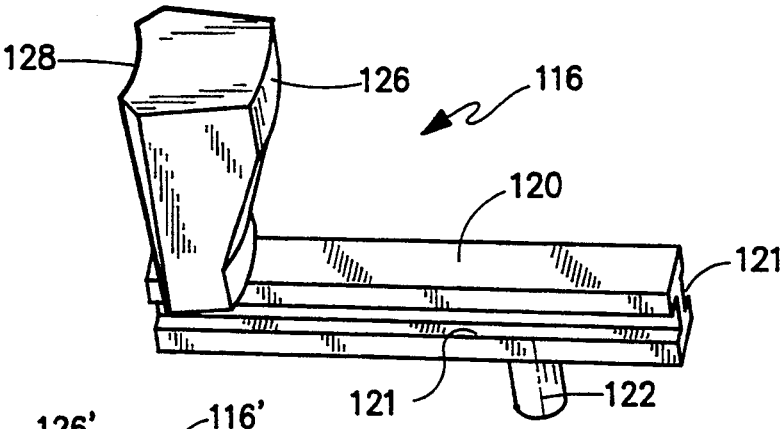
FIG. 8(*a*) and 8(*b*) are perspective views of first and second types of the first die elements used with the necking assembly shown in FIGS. 6 and 7.
Figure 8B:
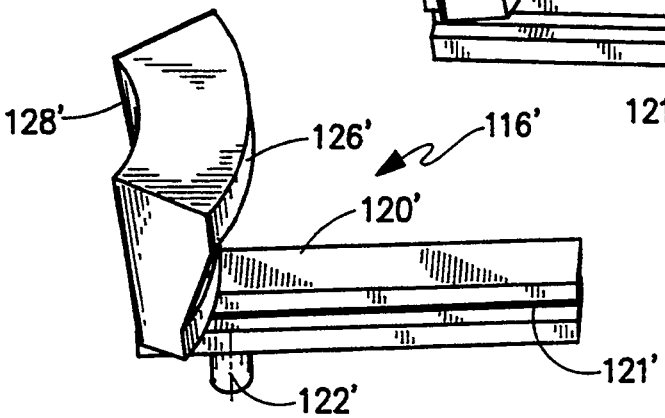

A representative necking assembly 72 along with its associated die assembly 80 is best shown in FIGS. 6 and 7. In FIG. 6, die assembly 80 is in the expanded state while in FIG. 7, die assembly 80 is in the retracted state. As may be seen in these Figures, an inner die is provided in the form of a plurality of cooperative first die elements 82 and a second die element 84 in the form of a frustoconical wedge. An outer die is provided, preferably in the form of a plurality of forming rollers 88 each of which is rotatably journaled on an axle pin 90 with associated bearings 94 located on a lip portion 92 of collar 74. As described below with reference to FIGS. 10 and 11, first die elements 82 and rollers 88 form a necking channel 100 operative to receive an end portion of a can blank 30. Rollers 88 relatively revolve around the inner first and second die elements.

Further, as is shown in FIGS. 6 and 7, a die cam 96 is rigidly secured to drive plate 28 and a wedge cam 98 is slideably received in channel bracket 99 that is likewise mounted on drive plate 28. An intermediate collar 102 is mounted for relative rotation with respect to die cam 96 by means of bearings 104 and outer collar 74 is mounted for relative rotation on intermediate collar 102 by means of bearings 106. As noted above, outer collar 74 includes gear teeth, such as gear teeth 75, which mate with gear teeth 61 of ring gear 60. As drive plate 28 is advanced, it may now be seen that collar 74 is relatively rotated around the central axis of die cam 96.

Reciprocal movement of die elements 82 and 84 are controlled by cam channels 66 and 70 formed in turret 16. Thus, as is seen in FIGS. 6 and 7, intermediate collar 102 has a cam follower 110 received in cam channel 70 formed in face 68 of turret 16. Similarly, wedge cam 98 includes a cam follower in the form of a roller 112 received in cam channel 66. Wedge cam 98 is connected at one end of a rod 76, and a frustoconical wedge 86 is disposed at an end of rod 76 opposite wedge cam 98. Rod 76 and wedge 86 have a longitudinal air passageway 78 extending therethrough. Accordingly, as described more thoroughly below, as collar 74 travels around the periphery of turret 16, cam channel 66 causes wedge cam 98 to reciprocally move wedge portion 86 so that it moves into and out of an interposed position within first die elements 82. Similarly, the same movement of collar 74 around the periphery of turret 16 causes intermediate collar 102 to shift back and forth with respect to die cam 96 and this, in turn, causes first die elements 82 to move between the expanded and retracted state.

The movement of the die elements can be more understood with references to FIGS. 6–13. First, with respect to FIGS. 8(*a*) and 8(*b*), it may be seen that first die elements 82 are formed of two types of complementary configurations. Thus, FIG. 8(*a*) shows a first die element 116 and FIG. 8(*b*) shows a first die element 116'. In either event, each of die elements 116, 116', are L-shaped in configuration and include a forming finger portion 118, 118', respectively, and an actuator 120, 120', respectively. First die element 116 includes a follower post 122 located at the distal end of actuator arm 120 while die element 116' includes a follower post 122' located to the proximate end of its actuator arm 120'. Each of actuator arms 120, 120' is provided with a pair of longitudinal guide grooves, such as grooves 121 and 121', respectively, so that they may be slideably mounted to intermediate collar 102. Forming finger 118 of each die element 116 has an outer surface 126 and an inner surface 128. Likewise, forming finger 118' of each die element 116' has an outer surface 126' and an inner surface 128'.

Figure 10:
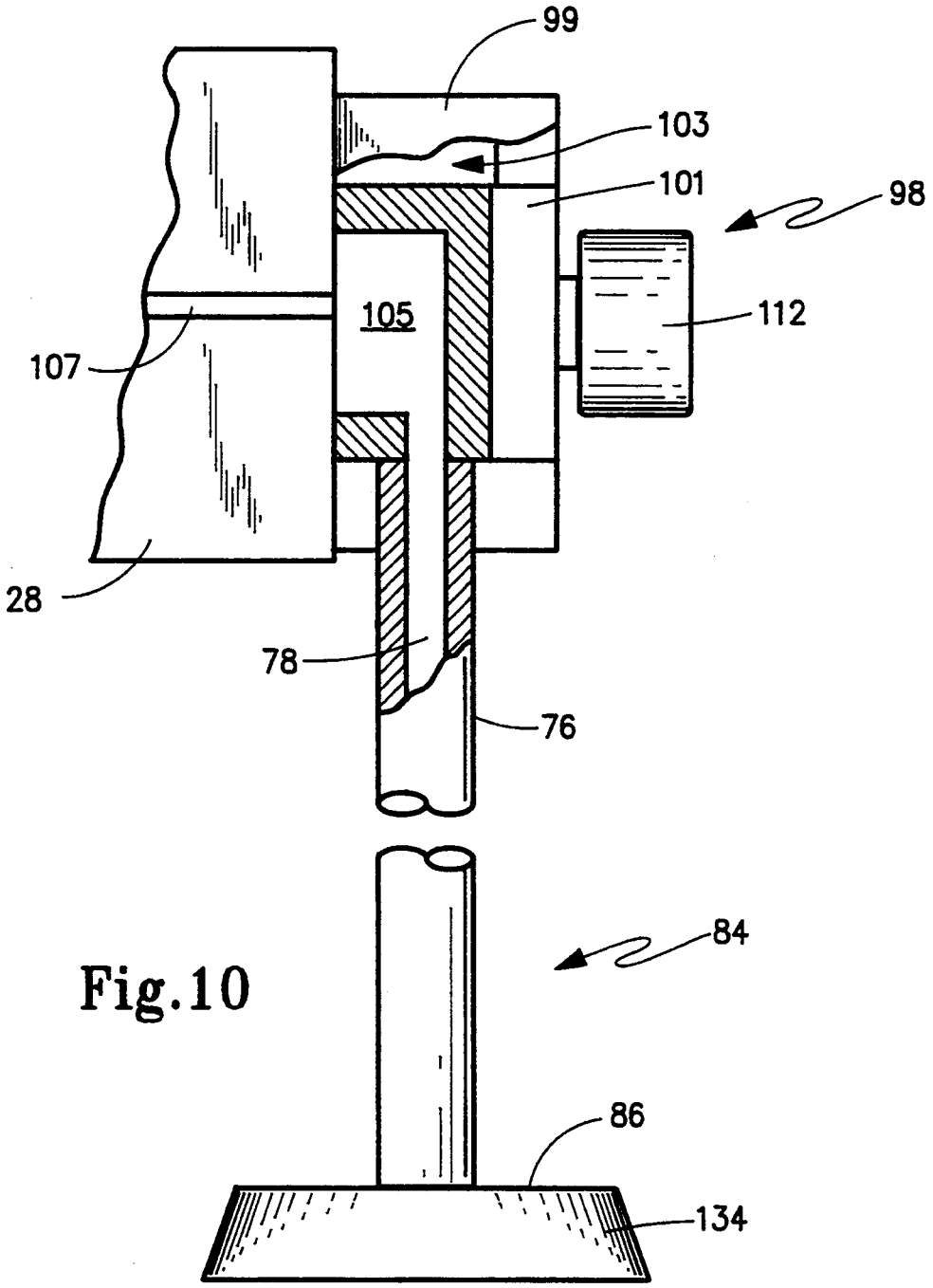
FIG. 10 is a perspective view of a second die element used with the necking assembly shown in FIGS. 6 and 7.

Turning to FIG. 10, it may be seen that wedge cam 98 includes a follower roller 112 rotatably journaled to a slide block 101 slideably received in a T-shaped channel 103 formed in channel bracket 99. Rod 76 is rigidly secured to slide block 101 so that wedge portion 86 reciprocates as roller 112 in cam channel 66 causes slide block 101 to reciprocate in channel bracket 99. Channel bracket 101 has a manifold 105 that is in communication with an air passageway 107 in drive plate 28 and with passageway 78 in rod 76 so that air may be injected through rod 76 and wedge portion 86 to help eject a formed can from necking assembly 72.

Figure 11:
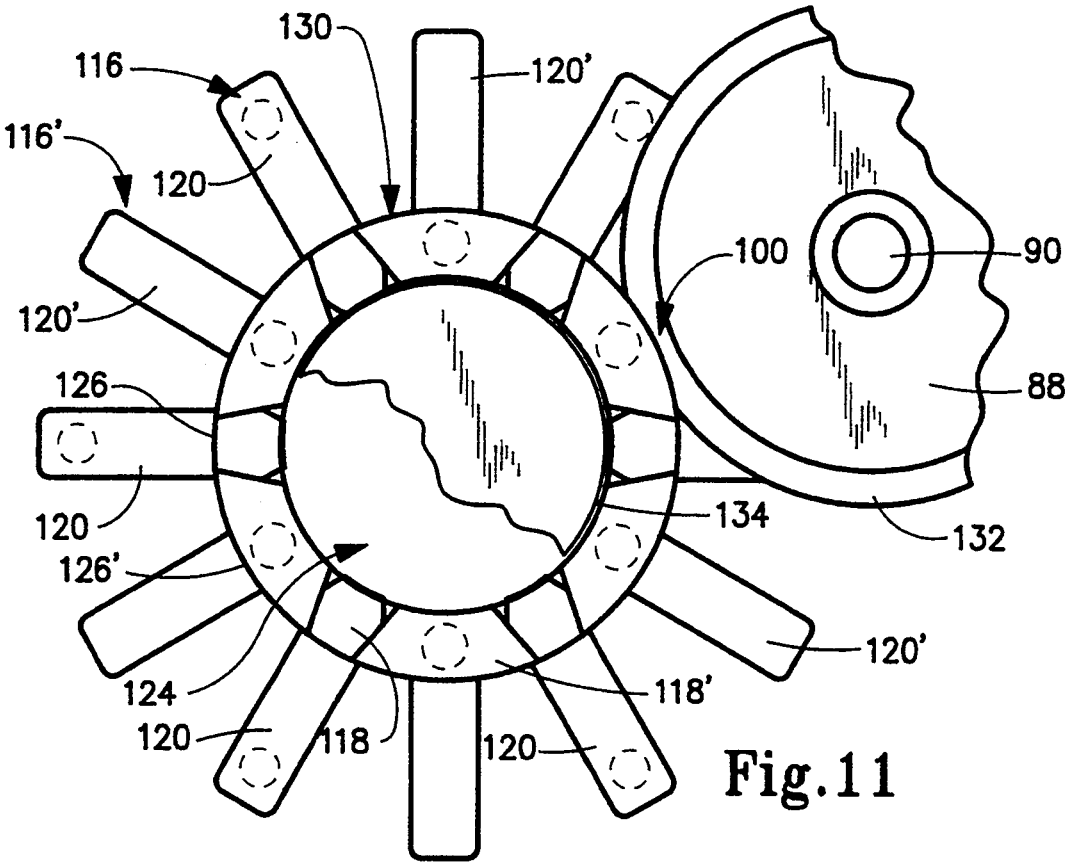
FIG. 11 is a bottom plan view, partially broken away, showing the die elements of FIGS. 8(*a*) and 8(*b*) along with the second die element and an outer roller die with the die elements in an expanded state.

As best shown in FIG. 11, when first die elements 116, 116' are in the expanded position, forming fingers 118, 118 are oriented in a cylindrical configuration around a circular opening 124 with actuator arms 120, 120' extending radially outwardly. Thus, forming fingers 118, 118' are generally parallel to one another. In the expanded state, shown in FIG. 11, outer surfaces 126, 126' form a continuous working surface 130. Each roller 88 includes a working surface 132 which is positioned in closely spaced relation to first working surface 130 when the first die elements 116, 116' are in the expanded state to provide the necking channel 100 therebetween. This necking channel 100 then is sized to receive the thickness of the sidewall of a can blank at the end portion to be necked.

Circular wedge portion 86 of second die element 84 is sized for interposition within circular region 124 in order to support forming fingers 118, 118' when die elements 116, 116' are in the expanded state. With reference again to FIG. 10, die element 84 includes a circular wedge portion 86 which is frustoconical in shape having an outer wall 134. Outer wall 134 is sized to abut inner surfaces 128, 128' of forming fingers 118, 118' when forming fingers 116, 116' are in the expanded state, as is shown in FIG. 11. Thus, wedge portion 86 helps prevent inward radial movement of forming fingers 118, 118' (and therefore die elements 116, 116') when a necking force is applied at working surface 132 acting against the end portion of a can blank 30. It should thus be appreciated that, as rollers 88 travel around the periphery of the open end portion of a can blank 30, working surface 22 will press the can sidewall against the working surface 130 to uniformly configure the end portion into the neck. Accordingly, working surfaces 130 and 132 are configured in a complementary shape of the neck to be formed.

Figure 12:
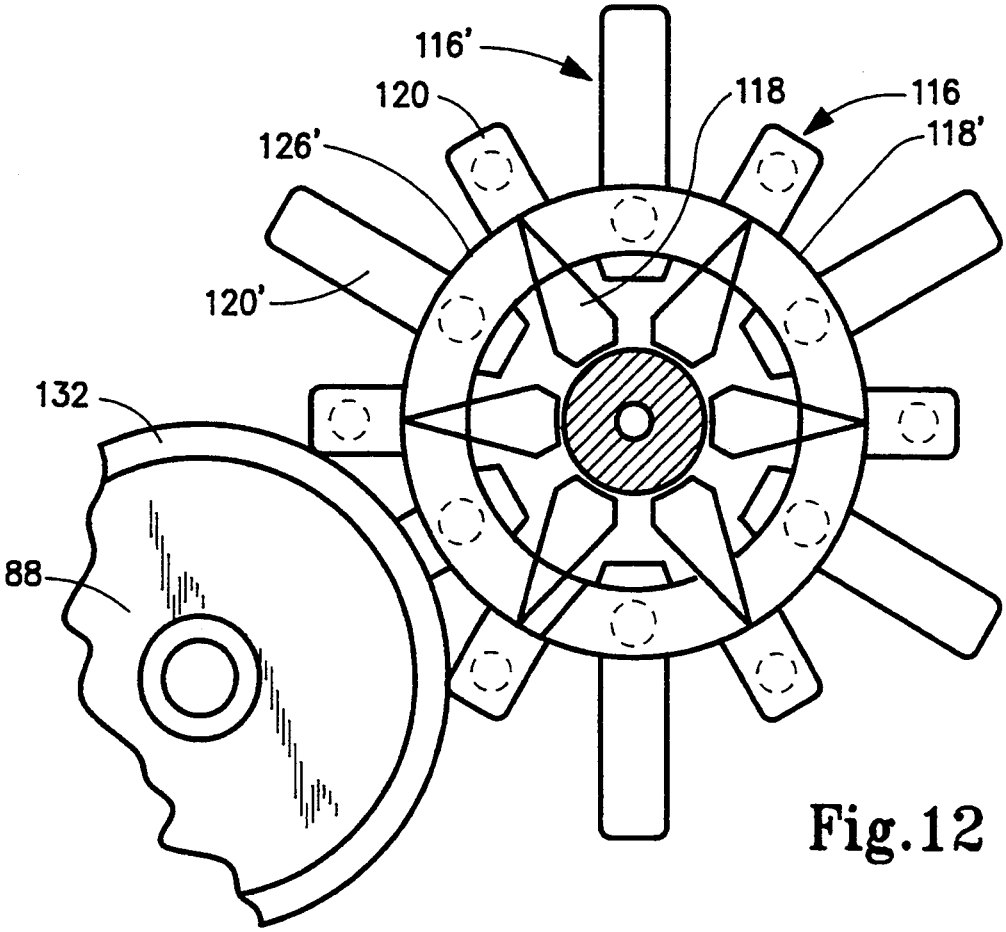
FIG. 12 is a bottom plan view similar to FIG. 11 showing the die elements in a retracted state.
Figure 16:
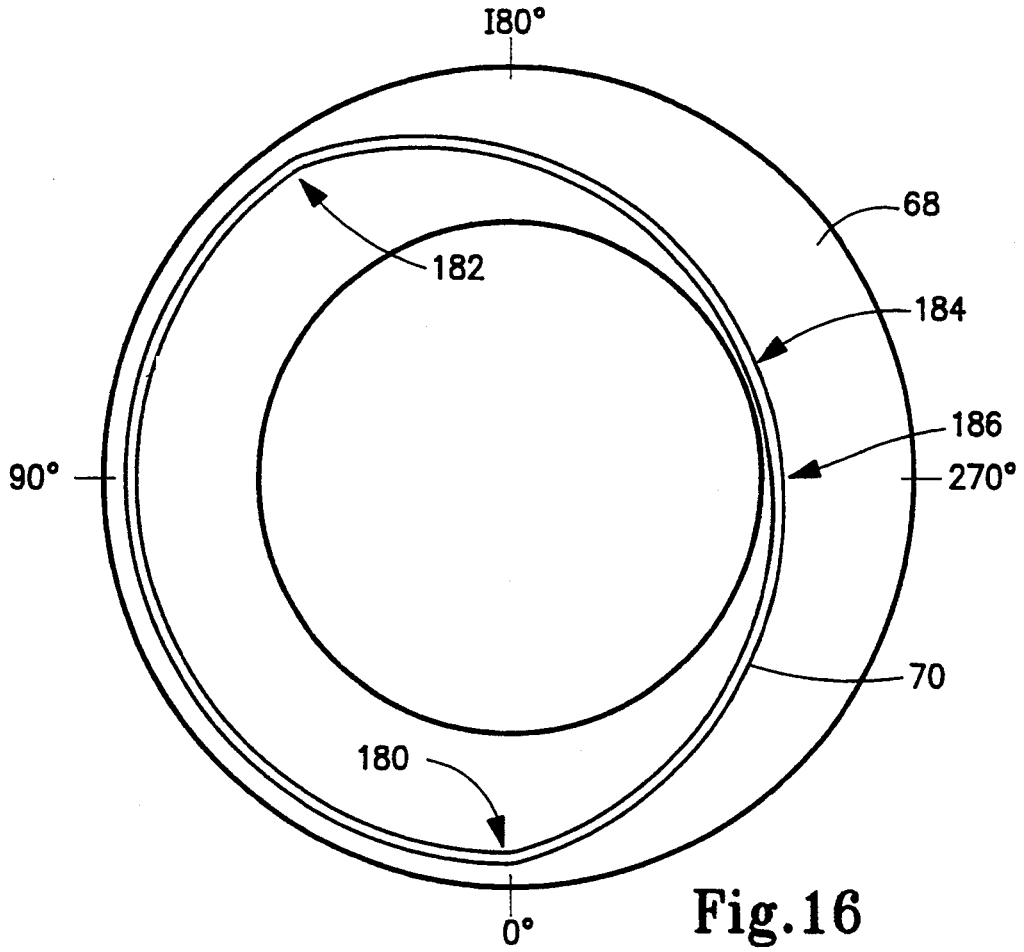
FIG. 16 is a diagrammatic view of the die element cam.
Figure 17:
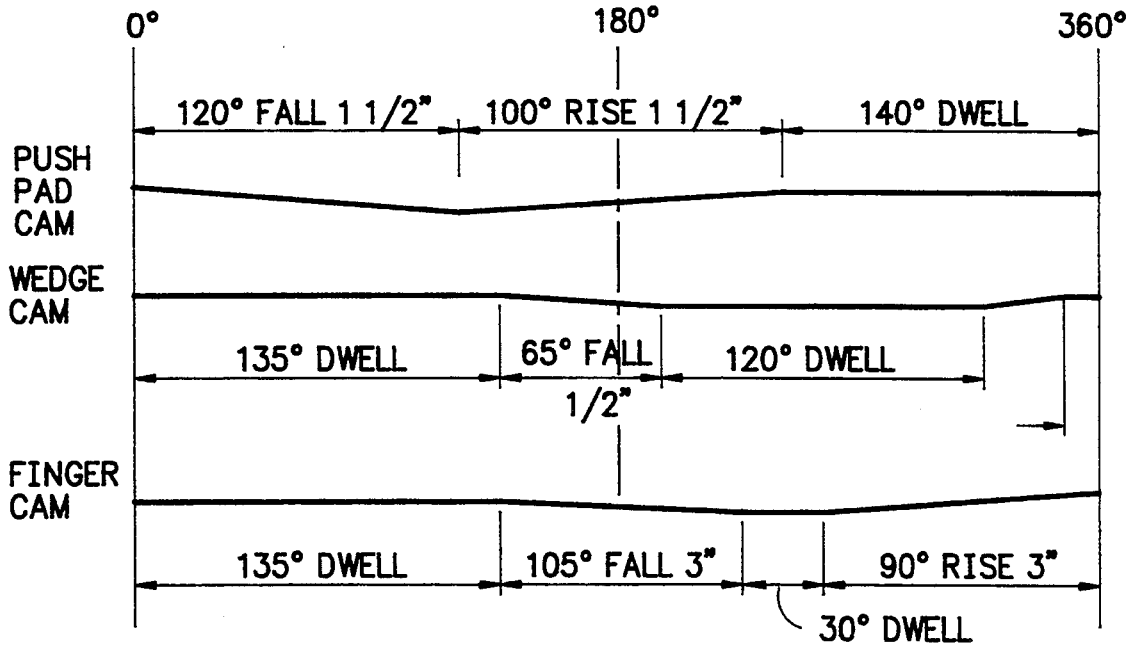
FIG. 17 is a graph showing the timing of the first and second die elements along with the push plates used according to the exemplary apparatus and method of the present invention.

Since the neck, once formed, has a reduced diameter, it is necessary to be able to withdraw forming finger 118, 118' from the smaller opening. Accordingly, it is necessary that first die elements 116, 116' be able to move into a collapsed state of reduced cross-sectional area. It is for this reason, that the first die is formed of a plurality of cooperative die elements that can move into the circular opening. Furthermore, it should be apparent from a review of FIGS. 11 and 12 that it is necessary to relatively move die elements 116 a greater distance radially inwardly than die elements 116'. As is shown in FIG. 12, then, it should be appreciated that, after circular wedge portion 86 is advanced out of circular opening 124, die elements 116 are advanced radially inwardly to be adjacent shaft 76 of second die element 84. As die elements 116 are advanced radially inwardly, die elements 116' can also be advanced radially inwardly a distance until finger portions 118' contact one another as is shown in FIG. 12. The cross section of the resulting configuration is now reduced to less than the opening size of formed can 40 so that finger portions 118, 118' can be withdrawn from the interior of the formed can.

This configuration is further shown in FIG. 7 where it is seen that second die element 84 has been advanced downwardly from first die elements 82 (comprising die elements 116, 116') so that die element 82 has a cross section that is approximately the same as cross section of circular wedge portion 86. Formed can blank 40 may then be moved downwardly out of the opening forming channel 100 to discharge can blank 40 form necking assembly 72. Necking assembly 72 is thereafter available for another can blank 30.

Figure 9:
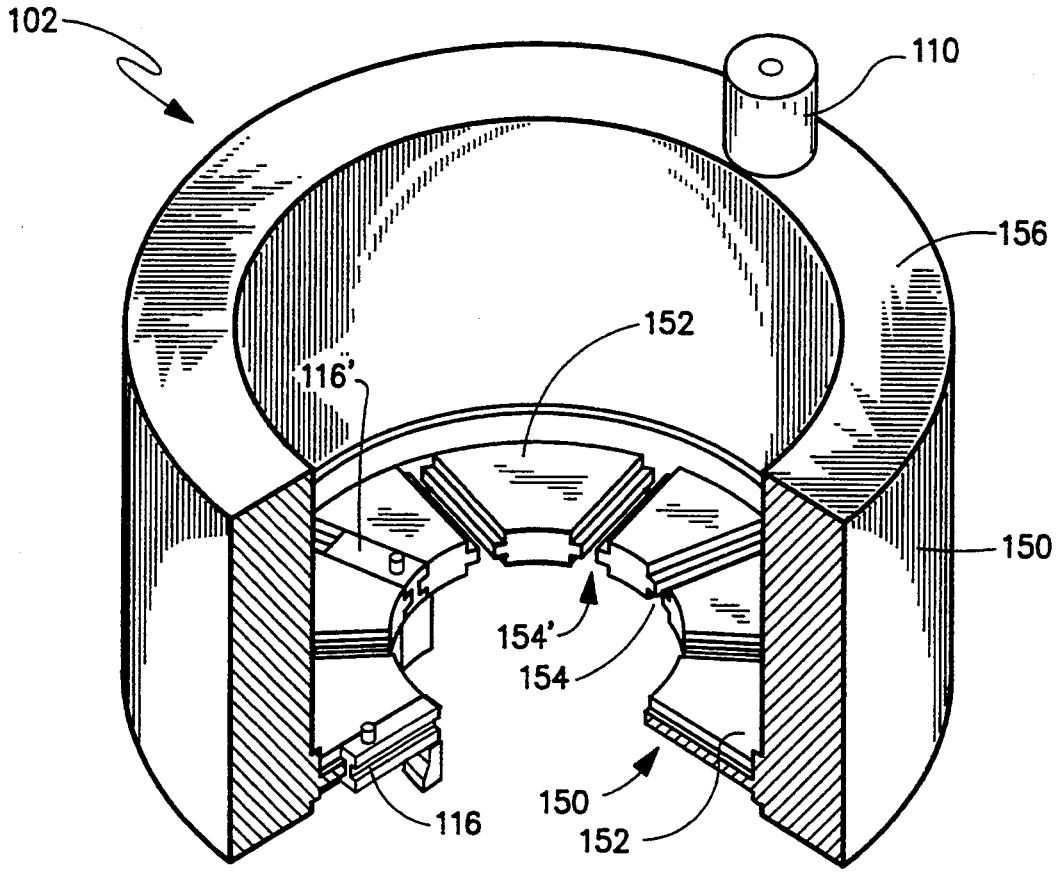
FIG. 9 is a perspective view, partially broken away of the intermediate collar receiving the first die elements show in FIGS. 8(*a*) and 8(*b*)

From the foregoing, it should be fully understood that it is necessary to reciprocally advance die elements 116, 116' in the radial direction and, to this end, die cam 96 is provided to cooperate with intermediate collar 102. With reference to FIG. 9, it may be seen that intermediate collar 102 is in the form of a cylindrical shell having a sidewall 150 and an endwall 152 formed of a plurality of wedge-shaped sections 152. Sections 152 are separated by radial slots 154, 154' which are H-shaped in cross-section and which are sized and configured to slideably receive a respective actuator arm 120, 120' of die elements 116, 116'. An upper rim 156 of sidewall 150 rotatably supports follower roller 110 which, as noted before, engages cam channel 70 in turret 16. As each necking assembly 72 travels around the inner periphery of turret 16, each intermediate collar 102 is thereby caused to reciprocate.

Figure 13:
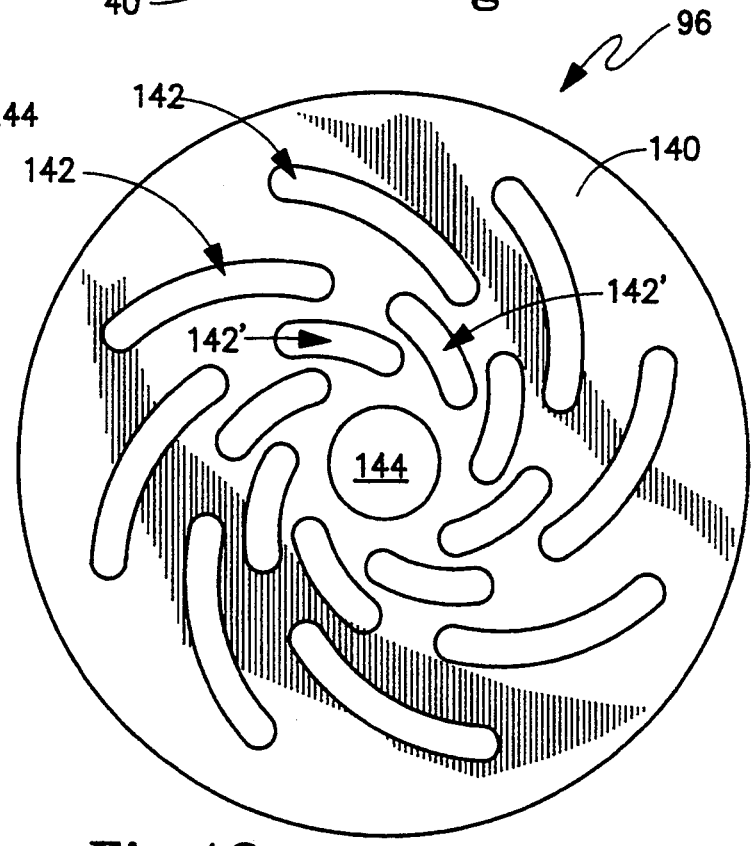
FIG. 13 is a bottom plan view of the die cam operative to drive the first die elements into an out of the retracted states shown in FIGS. 8 and 9.

With reference to FIG. 13, it may be seen that die cam 96 has a die face 140 provided with a plurality of slots 142, 142' that are arcuate in shape and vary in radial distance from shaft opening 14. Slots 142 are operative to receive follower posts 122 of respective first die elements 116 while slots 142' are sized to receive follower posts 122'. Accordingly, as intermediate cam 102 reciprocates, die cam 96, which is rigidly fastened to drive plate 28, causes die elements 116, 116' to move radially between the expanded and retracted positions. Due to the difference in the change of radius of these slots, it may be seen also with reference to FIGS. 7 and 12 that the respective die elements 116, 116' will be advanced a different radial magnitude allowing forming fingers 118 to nest within forming fingers 118'.

From the above description, it should be understood that it is necessary to relatively advance a can blank into the forming channel 100 so that the neck may be formed at the open end. With reference again to FIGS. 1 and 4, it may be seen that each consecutive can is supported on a push pad 46 supported by push rod 48. Each push rod 48, as noted, is slideably supported in push rod guide plate 26 which rotates in conjunction with shaft 18, star wheel 24 and each necking assembly 72. A push pad cam 27 is mounted on platen 14 and is in the form of a circular rim having a varying height. Follower roller 50 of each push plate assembly 44 thus follows the upper edge 25 of cam 27 so that as the height of edge 25 changes, push pads 46 are moved upwardly or downwardly to advance and retract cans 30, 40 from necking assembly 72. It should therefore be appreciated that the present invention provides a plurality of necking stations each including a necking assembly 72 and a push rod assembly 44 operating in conjunction with a respective bay 34 in star wheel 24.

Figure 14:
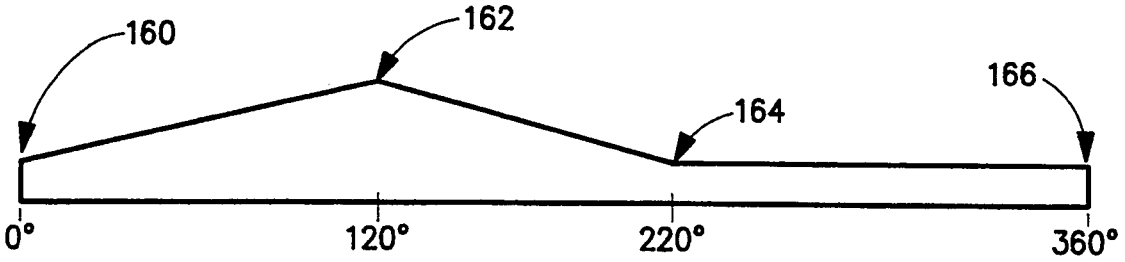
FIG. 14 is a diagrammatic view of the push pad cam.

In order to relatively time the actuation of the push pads and the die assemblies 80, it is necessary to properly configure push pad cam 27 along with cam channels 66 and 70. This timing is best shown in FIGS. 14–17 where it may be seen that FIG. 14 represents a diagrammatic view of push pad cam 27. Here it may be seen that, at location 160, a respective push pad 46 is in its lowermost position. During a "fall" period between location 160 and 162, each push pad 46 would be advanced toward a necking assembly 72 so that a can blank 140 would be advanced into necking channel 100. The open end of a can blank 30 would be completely within necking channel 100 at location 162 and would be accordingly necked. During a "rise" period from location 162 to location 164, push pad 46 retreats from necking assembly 72 so that the necked can 40 withdraws from necking assembly 72. During the "dwell" period from 164 to 166, push pad 46 is fully retracted and allows for the discharge of necked cans from and loading of can blanks into necking apparatus 10.

Figure 15:
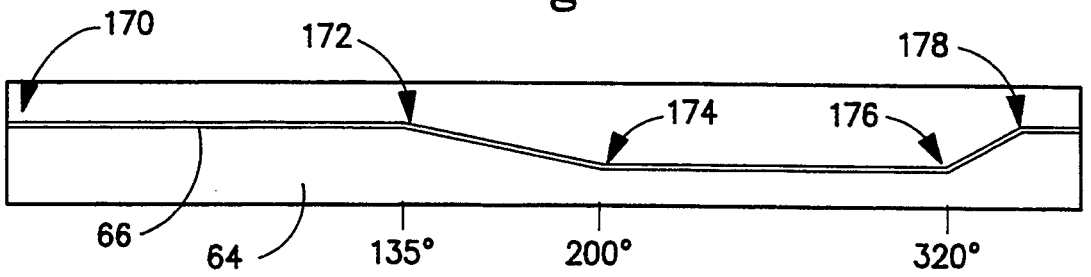
FIG. 15 is a diagrammatic view of the wedge cam channel.

FIG. 15 diagrammatically shows the wedge cam channel 66. With reference to this Figure and FIG. 17, it may be seen that, during a dwell period from O° (location 170) to 135° (location 172), wedge cam portion 86 is in the first position shown in FIG. 11, that is, fully engaging die elements 116, 116'. Over the next 65°, wedge cam portion 86 moves out of engagement into the second position, as shown at location 174. It remains in this position, i.e., dwells, for 120° until, at 176, wedge cam portion moves into the first position in an interval of 25°. When fully engaged, at 178, it dwells for the remainder of the cycle. It should be appreciated, therefore, that the total dwell in the engaged position equals 150°. Similarly, with reference to FIGS. 16 and 17, it may be seen that die elements 116, 116' are in the expanded position from location 180 to location 182, an interval of 135° after which they begin to retract or "fall" over the next 105° to location 184. They are in the retracted position, beginning at 184 for a 30° dwell, until location 186, after which they move toward the expanded position over the course of 90°.

In operation, it should now be readily understood that consecutive can blanks 30 are received from feed chute 32 and are advanced into a respective necking assembly 72 as its push pad 46 is elevated by push pad cam 27. During this period of time, die elements 116, 116' are in the expanded position and the second die element is elevated to advance circular wedge portion 86 into the circular opening 124 between forming fingers 118, 118'. At all times, forming rollers 88 are rotating on their axes and revolving around the die assembly composed of the first and second die elements so that forming channel 100 is created to receive the upper edge portion of the can blank 30. As push pad 40 continues to advance the can blank 40, the open rim of the can blank begins to enter forming channel 100 and begins to be reduced in diameter since forming rollers 80 are revolving therearound. This forms a smooth continuous neck as the can blank is fully advanced into the forming channel. After a period of dwell, circular wedge portion 86 is moved out of opening 124 and die elements 116, 116' are moved to the collapsed state so that they are organized in a configuration of smaller diameter than the neck opening. At this point, push pad 46 may descend as the follower roller 50 ramps downwardly along edge 25 of push pad cam 27 so that the formed can 40 moves away form necking assembly 72. After full descent, the formed can 40 is discharged at discharge chute 42.

From the foregoing description, it should now be understood that the present invention provides a method of necking the end portion of a tubular member, such as a can or other container, to form a reduced diameter opening. The broad method therefore includes a series of processing steps, as follows. First, the method includes the step of providing an inner die that is relatively insertable into the interior of the tubular member at an end portion thereof with the interior die being constructed of a plurality of cooperative die sections movable between an expanded state to form a first working surface configured in a shape corresponding to the neck to be formed and movable into a retracted state wherein the die sections can be removed from the interior of the tubular member after the neck is formed. Second, the broad method includes the step of providing an outer die having a second working surface configured in a shape complementary to the first working surface and positioned in closely spaced relation to the first working surface when the die sections are in the expanded state thereby to provide a necking channel. The method then includes the step of reciprocally driving the die sections between the expanded state an the retracted state and placing the end portion of the tubular member into the necking channel when the die sections are in the expanded state. During the time when the end portion of the tubular member is in the necking channel, the broad method includes the step of advancing the outer die around the interior die to conform the end portion of the tubular member into the neck. Finally, the broad method includes the step of separating the tubular member and the inner die after the neck is formed while the die sections are in the retracted state. The method may also include the steps of positively supporting the die sections in the expanded state and the tubular member during the necking operation. Further, it should be understood that the method could include the steps inherent in the foregoing description of the apparatus.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. An apparatus for necking an end portion of a tubular member which has an interior and a selected diameter, said apparatus operative to form a neck having a reduced diameter and comprising:

(a) an inner die relatively insertable into the interior of said tubular member at said end portion thereof said inner die having a circumferential first working surface configured in a shape corresponding to the neck to be formed and including a plurality of cooperative first die elements movable between an expanded state wherein said first die elements are positioned in a common cylindrical configuration to provide the working surface and a retracted state wherein selected ones of said first die elements are nested within other ones of said first die elements in an offset relationship to one another so that said inner die can be removed from the interior of said tubular member after the neck is formed;

(b) an inner die drive assembly operative to reciprocally drive said first die elements between the expanded state and the retracted state;

(c) an outer die having a second working surface configured in a shape complementary to the first working surface and positioned in closely-spaced relation to the first working surface when said first die elements are in the expanded state to provide a necking channel therebetween, said necking channel operative to receive the end portion of said tubular member; and (d) an outer die drive assembly operative to advance said outer die around said inner die when said first die elements are in the expanded state and when said end portion of said tubular member is in the necking channel thereby to conform said end portion into said neck.

2. An apparatus according to claim 1 wherein said outer die includes at least one roller die having a circumferential surface defining the second working surface, said roller die journaled for rotation on a roller axis.

3. An apparatus according to claim 2 including a plurality of roller dies equiangularly spaced around said inner die.

4. An apparatus according to claim 3 wherein said outer die drive assembly including a rotatable collar surrounding said inner die said roller die being mounted for rotation with respect to said collar.

5. An apparatus according to claim 4 wherein said collar is formed as a planetary gear, said outer die drive assembly including a ring gear operative to engage and drive said collar.

6. An apparatus according to claim 1 including means for relatively inserting and removing the end portion of said tubular member from the necking channel.

7. An apparatus according to claim 1 wherein said inner die drive assembly operates to reciprocate said selected ones of said first die elements differentially with respect to the others of said first die elements.

8. An apparatus for necking an end portion of a tubular member which has an interior and a selected diameter, said apparatus operative to form a neck having a reduced diameter and comprising:

(a) an inner die relatively insertable into the interior of said tubular member at said end portion thereof said inner die having a first working surface configured in a shape corresponding to the neck to be formed and including a plurality of cooperative first die elements movable between an expanded state wherein said first die elements provide the working surface and a retracted state wherein said first die element can be removed from the interior of said tubular member after the neck is formed each said first die element is constructed as an L-shaped piece having a forming finger and an actuator arm said first die elements arranged so that said forming fingers are oriented in a cylindrical configuration with said actuator arms extending radially outwardly and with said forming fingers parallel to one another circumferentially around said cylindrical configuration when said first die elements are in the expanded state;

(b) an inner die drive assembly operative to reciprocally drive said first die elements between the expanded state and the retracted state;

(c) an outer die having a second working surface configured in a shape complementary to the first working surface and positioned in closely-spaced relation to the first working surface when said first die elements are in the expanded state to provide a necking channel therebetween, said necking channel operative to receive the end portion of said tubular member; and (d) an outer die drive assembly operative to advance said outer die around said inner die when said first die elements are in the expanded state and when said end portion of said tubular member is in the necking channel thereby to conform said end portion into said neck.

9. An apparatus according to claim 8 wherein said inner die drive assembly includes a die cam operative to advance and retract said actuator arms in a radial direction whereby said forming fingers are moved radially apart from one another when in the expanded state and radially toward one another when in the retracted state.

10. An apparatus according to claim 9 wherein said die cam has a die cam surface provided with a plurality of slots each associated with a respective said first die element and wherein each said actuator arm includes an actuator post sized to be received in a respective slot in said die cam surface whereby said actuator posts follow said slots when said die cam is reciprocally rotated thereby to advance and retract said actuator arms.

11. An apparatus according to claim 8 wherein said inner die includes a second die element formed as a circular wedge axially movable with respect to said forming fingers between a first position interposed within the cylindrical configuration of said forming fingers, when said first die elements are in the expanded state and a second position removed from the cylindrical configuration of said forming fingers said second die element operative in the first position to support said fingers against radially inward movement thereby to prevent said first die elements from moving into the retracted state and operative in the second position to permit movement of said first die elements into the retracted state.

12. An apparatus according to claim 11 including a wedge cam drive assembly connected to said second die element and operative to reciprocally drive said second die element between the first and second positions.

13. An apparatus according to claim 12 including timing means for causing said wedge cam drive assembly to drive said second die element into the first position after said inner die drive assembly drives said first die elements into the expanded state an for causing said wedge cam drive assembly to drive said second die element into the second position before said die drive assembly drives said first die elements into the retracted state.

14. An apparatus for necking an open end portion of a cylindrical can which has an interior and a selected diameter, said apparatus operative to form a neck having a reduced diameter and comprising:

(a) an inner die relatively insertable into the open end and having a first working surface configured in a shape corresponding to the neck to be formed and including a plurality of cooperative first die elements movable between an expanded state and a retracted state, each said first die element including a forming finger and an actuator arm, said first die elements arranged so that said forming fingers are oriented in a cylindrical configuration with said actuator arms extending radially outwardly and with said forming fingers parallel to one another circumferentially around said cylindrical configuration when said first die elements are in the expanded state whereby said forming fingers define the first working surface when in the expanded state, said forming fingers when in the retracted state being removable from the interior of said can after the neck is formed;

(b) a die drive assembly operative to reciprocally drive said die sections between the expanded state and the collapsed state;

(c) an outer die including roller rotatable on a roller die axis and having a second working surface configured in a shape complementary to the first working surface, said roller positioned so that the second working surface is in a closely-spaced relation to the first working surface when said die sections are in the expanded state to provide a necking channel therebetween operative to receive the end portion of said tubular member; and (d) a drive assembly operative to advance said roller die around said interior die when said die sections are in the expanded state and when said end portion of said tubular member is in the necking channel whereby said roller die is rotated to roll the second working surface against said end portion to conform said end portion against the first working surface thereby to form said neck.

15. An apparatus according to claim 14 wherein said inner die includes a second die element formed as a circular wedge axially movable with respect to said forming fingers, between a first position interposed within the circular configuration of said forming fingers, when said first die elements are in the expanded state and a second position removed from the circular configuration of said forming fingers said second die element operative in the first position to support said fingers against radially inward movement thereby to prevent said first die elements from moving into the retracted state and operative in the second position to permit movement of said first die elements into the retracted state.

16. An apparatus according to claim 15 including a wedge cam drive assembly connected to said second die element and operative to reciprocally drive said second die element between the first and second positions.

17. An apparatus according to claim 16 including timing means for causing said wedge cam drive assembly to drive said second die element into the first position after said die drive assembly drives said first die elements into the expanded state an for causing said wedge cam drive assembly to drive said second die element into the second position before said die drive assembly drives said first die elements into the retracted state.

18. An apparatus according to claim 14 wherein said outer die includes a collar rotatable on a collar axis, said roller die being rotatably journaled on said collar whereby, as said collar rotates about said collar axis, said roller die revolves about said die sections.

19. An apparatus according to claim 18 wherein said collar is formed as a planetary gear, said outer die drive assembly including a ring gear operative to engage and drive said collar.

20. An apparatus according to claim 14 including means for relatively inserting and removing the end portion of said tubular member from the necking channel.

21. An apparatus for necking open end portions of cylindrical cans each of which having an interior and a selected diameter, said apparatus operative to form a neck having a reduced diameter and comprising:

(a) a turret having an inwardly facing ring gear structure;

(b) a drive wheel rotatably journaled with respect to said turret;

(c) a plurality of necking stations mounted on said drive wheel, each said necking station including an inner die assembly having a plurality of cooperative first die elements movable between an expanded state wherein said first die elements provide a first working surface and a retracted state wherein some of said first die elements are nested within others of said first die elements in an offset relationship to one another and including an outer die assembly having a second working surface configured in a shape complimentary to the first working surface and positioned in a closely-spaced relation to the first working surface when said first die elements are in the expanded state to provide a necking channel therebetween, said necking channel operative to receive the end portion of said tubular member, each said necking station including a collar rotatably journaled with respect to said drive wheel and having collar gear teeth, each said collar mounted for operative engagement with said ring gear structure;

(d) a star wheel mounted for common rotation with said drive wheel and operative to engage cans in an aligned relationship with each one of said necking stations; and (e) a push pad assembly associated with said star wheel and operative to advance successive ones of said cans into and out of said necking stations when said first die elements are respectively in the expanded and retracted states.

22. Apparatus according to claim 21 wherein each of said outer die assemblies includes a plurality of roller dies rotatably journaled to a respective collar, said roller dies being equiangularly spaced about respective collar axis.

23. A method for necking an open end portion of a tubular member which has an interior in order to form a neck having a reduced diameter, comprising the steps of:

(a) providing an inner die that is relatively insertable into the interior of the tubular member at an end portion thereof with said inner die being constructed of a plurality of cooperative die sections movable between an expanded state wherein a first working surface configured in a shape corresponding to the neck to be formed is provided and movable into a retracted state wherein said die sections are separated with selected ones of said die sections nested within other ones of said die sections in an offset relationship to one another so that said inner die can be removed from the interior of the tubular member after the neck is formed;

(b) providing an outer die having a second working surface configured in a shape complimentary to the first working surface and positioned in closely spaced relation to the first working surface when the die sections are in the expanded state thereby to provide a necking channel;

(c) reciprocally moving said die sections between the expanded and the retracted state;

(d) inserting the end portion of the tubular member into the necking channel when the die sections are in the expanding state and advancing the outer die around the inner die to conform the end portion of the tubular member into the neck; and (e) moving said die sections into the retracted state and removing the tubular member therefrom.

24. The method according to claim 23 including the step of positively supporting said die sections when in the expanded state.

25. The method according to claim 23 including the step of positively supporting the tubular member when the open end thereof is inserted into the necking channel.

26. The method according to claim 23 wherein the step of reciprocally moving said die sections includes differentially moving said die sections whereby said selected ones of said die sections may be nested with said other ones of said die sections.

* * * * *